US011891925B2

(12) United States Patent
Mlinaric

(10) Patent No.: US 11,891,925 B2
(45) Date of Patent: Feb. 6, 2024

(54) CAMSHAFT PHASER WITH TRIGGER WHEEL INCLUDING MAGNETIC MATERIAL

(71) Applicant: Schaeffler Technologies AG & Co. KG, Herzogenaurach (DE)

(72) Inventor: Andrew Mlinaric, Lakeshore (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 122 days.

(21) Appl. No.: 17/096,702

(22) Filed: Nov. 12, 2020

(65) Prior Publication Data

US 2022/0145784 A1 May 12, 2022

(51) Int. Cl.
*F01L 1/344* (2006.01)

(52) U.S. Cl.
CPC ..... *F01L 1/3442* (2013.01); *F01L 2820/041* (2013.01)

(58) Field of Classification Search
CPC ... F01L 1/3442; F01L 2820/041; F01L 1/047; F01L 1/344; F01L 2301/00; F01L 2001/34483; F02D 41/009
USPC ..... 123/90.17
See application file for complete search history.

(56) References Cited

U.S. PATENT DOCUMENTS

| | | | | |
|---|---|---|---|---|
| 6,732,690 | B2 * | 5/2004 | Pierik | F01L 1/3442 123/90.15 |
| 7,051,688 | B2 * | 5/2006 | Lancefield | F01L 1/3442 123/90.11 |
| 10,895,179 | B2 * | 1/2021 | Kandolf | F01L 1/3442 |
| 10,954,828 | B2 * | 3/2021 | Camilo | B21D 53/84 |
| 2005/0235938 | A1 * | 10/2005 | Tani | F01L 1/352 123/90.17 |
| 2006/0279279 | A1 * | 12/2006 | Foley | G01D 5/145 324/207.25 |
| 2007/0215079 | A1 * | 9/2007 | Boggess | F01L 1/26 123/90.15 |
| 2018/0230865 | A1 * | 8/2018 | Brown | H02K 29/08 |
| 2019/0285439 | A1 * | 9/2019 | Santos | G01D 5/2458 |

* cited by examiner

*Primary Examiner* — Kenneth J Hansen
*Assistant Examiner* — Kelsey L Stanek
(74) *Attorney, Agent, or Firm* — Volpe Koenig

(57) ABSTRACT

A camshaft phaser, including: an input element arranged to receive a first rotational torque and rotatable about an axis of rotation; an output element rotatable about the axis of rotation, rotatable with respect to the input element, arranged to non-rotatably connect to a camshaft, and arranged to transmit the first rotational torque to the camshaft; and a trigger wheel non-rotatably connected to the output element, arranged to identify a rotational position of the output element around the axis of rotation, and including a magnetic material with at least one segment having a first magnetic charge, and with at least one segment having a second magnetic charge, opposite the first magnetic charge.

10 Claims, 11 Drawing Sheets

CAMSHAFT PHASER WITH TRIGGER WHEEL INCLUDING MAGNETIC MATERIAL

TECHNICAL FIELD

The present disclosure relates to a trigger wheel of a camshaft phaser including magnetic material.

BACKGROUND

For known camshaft phaser, the accuracy of a metal trigger wheel depends on strict tolerances during the fabrication of the trigger wheel. For example, strict tolerances for the physical structures formed during a stamping process for a steel trigger wheel.

SUMMARY

According to aspects illustrated herein, there is provided a camshaft phaser, including: an input element arranged to receive a first rotational torque and rotatable about an axis of rotation; an output element rotatable about the axis of rotation, rotatable with respect to the input element, arranged to non-rotatably connect to a camshaft, and arranged to transmit the first rotational torque to the camshaft; and a trigger wheel non-rotatably connected to the output element, arranged to identify a rotational position of the output element around the axis of rotation, and including a magnetic material with at least one segment having a first magnetic charge, and with at least one segment having a second magnetic charge, opposite the first magnetic charge.

According to aspects illustrated herein, there is provided a camshaft phaser, including: an input element rotatable around an axis of rotation and arranged to receive a rotational torque; an output element rotatable about the axis of rotation, rotatable with respect to the input element, arranged to non-rotatably connect to a camshaft, and arranged to transmit the rotational torque to the camshaft; a trigger wheel non-rotatably connected to the output element and arranged to identify a rotational position of the output element around the axis of rotation; and a magnetic material fixedly connected to the trigger wheel and including a plurality of first segments with a first magnetic charge and a plurality of second segments with a second magnetic charge, opposite the first magnetic charge, the second segments alternating with the first segments in a circumferential direction.

According to aspects illustrated herein, there is provided a method of operating a camshaft phaser including an input element, an output element, a trigger wheel non-rotatably connected to the output element, and a magnetic material fixedly connected to the trigger wheel and including a segment with a first magnetic charge and a segment with a second magnetic charge, opposite the first magnetic charge. The method includes: receiving, with the input element, a rotational torque; rotating the input element around an axis of rotation; transmitting, with the input element, the rotational torque to the output element; rotating the output element and the trigger wheel around the axis of rotation; transmitting, with the output element, the rotational torque to a camshaft non-rotatably connected to the output element; detecting, with a sensor, a circumferential position of the segment with the first magnetic charge; transmitting, with the sensor, a first sensor signal, including the circumferential position, to a control unit; creating, with the control unit and the first sensor signal, a first control signal; transmitting, using the control unit, the first control signal to a fluid control system or to an electric motor; and when the first control signal is transmitted to the fluid control system, rotating, using the fluid control system and according to the first control signal, the output element with respect to the input element, or when the first control signal is transmitted to the electric motor, rotating, using the electric motor and according to the first control signal, the output element with respect to the input element.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the present disclosure.

Unless defined otherwise, all technical and scientific terms used herein have the same meaning as commonly understood to one of ordinary skill in the art to which this disclosure belongs. It should be understood that any methods, devices, or materials similar or equivalent to those described herein can be used in the practice or testing of the disclosure.

Figure 1:
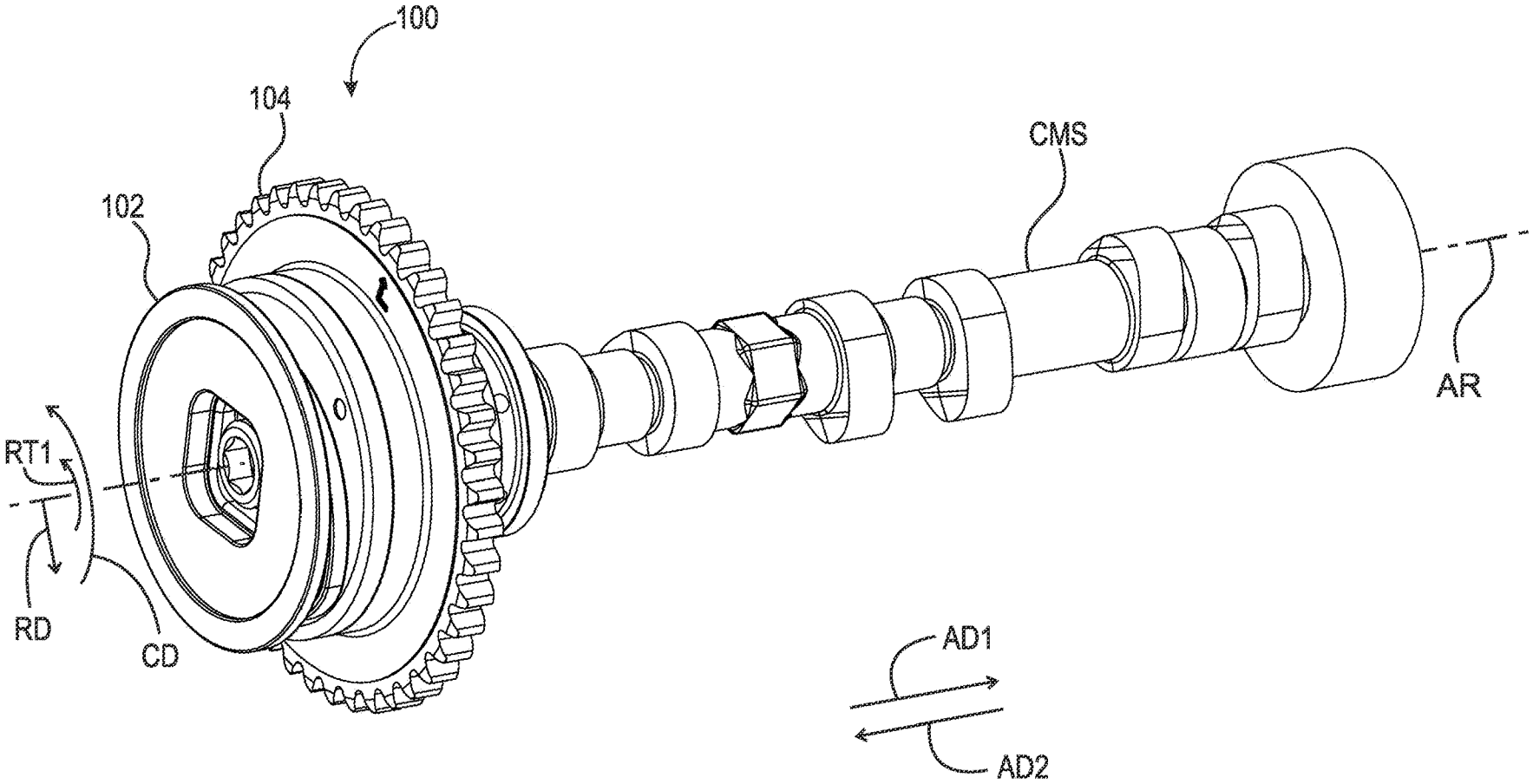
FIG. 1 is an isometric view of a camshaft phaser, with a trigger wheel including magnetic material, connected to a camshaft.

FIG. 1 is an isometric view of camshaft phaser 100, with trigger wheel 102 including a magnetic element, connected to camshaft CMS.

Figure 2:
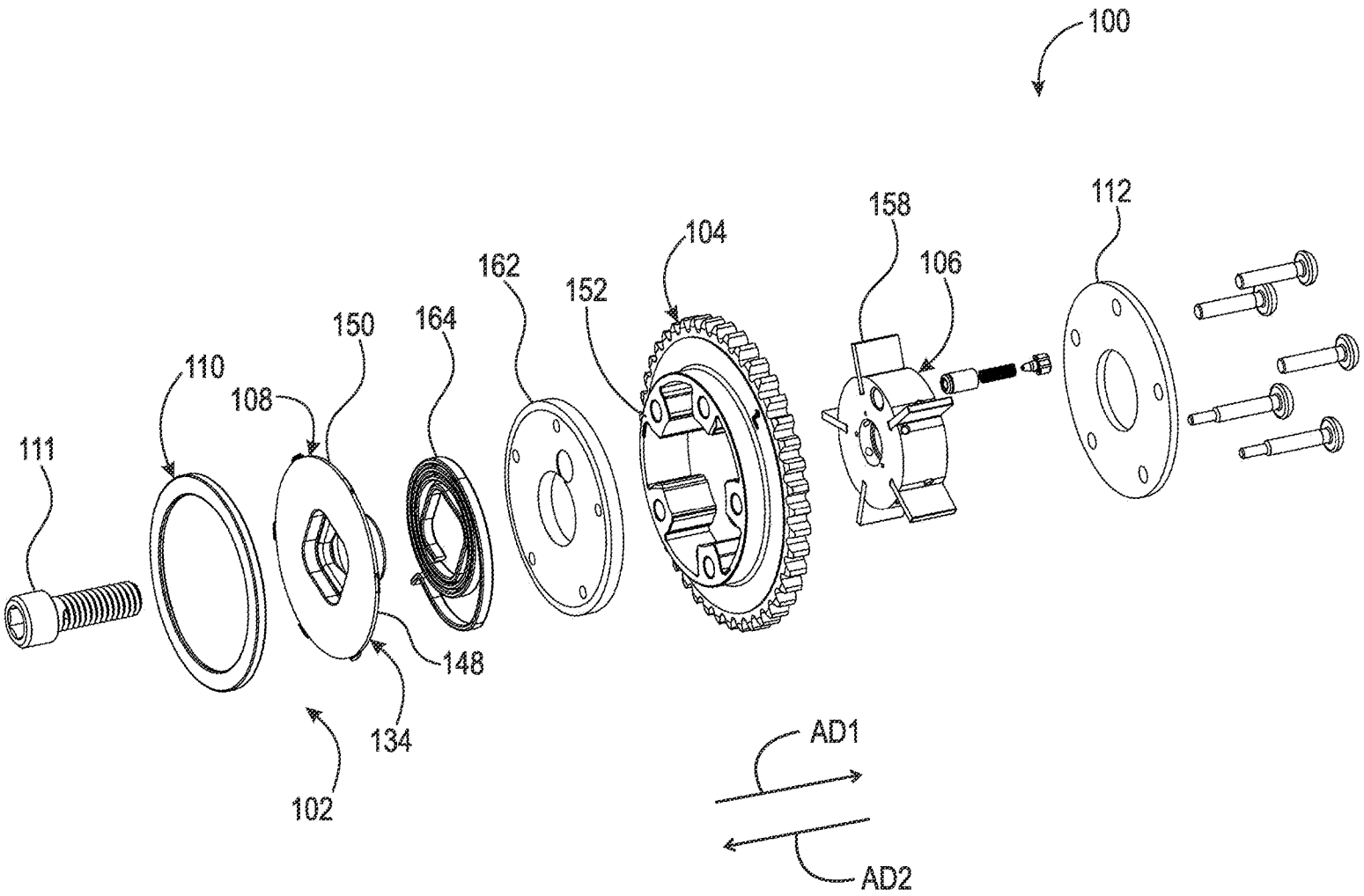
FIG. 2 is an exploded view of the camshaft phaser shown in FIG. 1.

FIG. 2 is an exploded view of camshaft phaser 100 shown in FIG. 1. The following should be viewed in light of FIGS. 1 and 2. Camshaft phaser 100 includes input element 104 and output element 106. Trigger wheel 102 includes: body portion 108 non-rotatably connected to output element 106; and magnetic element 110 fixedly connected to body portion 108. Input element 104: is rotatable around axis of rotation AR; is arranged to receive rotational torque RT1; and is arranged to transmit torque RT1 to output element 106, Torque RT1 is not limited to a particular circumferential direction. Output element 106: is rotatable around axis AR; is rotatable, with respect to input element 104, around axis of rotation AR; is arranged to non-rotatably connect to camshaft CMS; and is arranged to transmit rotational torque RT1 to camshaft CMS. In the example of FIG. 1, trigger wheel 102 is non-rotatably connected to output element 106 and output element 106 is non-rotatably connected to camshaft CMS by any means known in the art, including, but not limited to, camshaft bolt 111. Trigger wheel 102 is arranged to identify a rotational/circumferential position of output element 106 around axis of rotation AR. In the example of FIG. 1, camshaft phaser 100 includes rear seal plate 112.

By "non-rotatably connected" components, we mean that components are connected so that whenever one of the components rotates, all the components rotate; and relative rotation between the components is precluded. Radial and/or axial movement of non-rotatably connected components with respect to each other is possible. Components connected by tabs, gears, teeth, or splines are considered as non-rotatably connected despite possible lash inherent in the connection. The input and output elements of a closed clutch are considered non-rotatably connected despite possible slip in the clutch. The input and output parts of a vibration damper, engaged with springs for the vibration damper, are not considered non-rotatably connected due to the compression and unwinding of the springs. Without a further modifier, the non-rotatable connection between or among components is assumed for rotation in any direction. However, the non-rotatable connection can be limited by use of a modifier. For example, "non-rotatably connected for rotation in circumferential direction CD1," defines the connection for rotation only in circumferential direction CD1.

Figure 3:
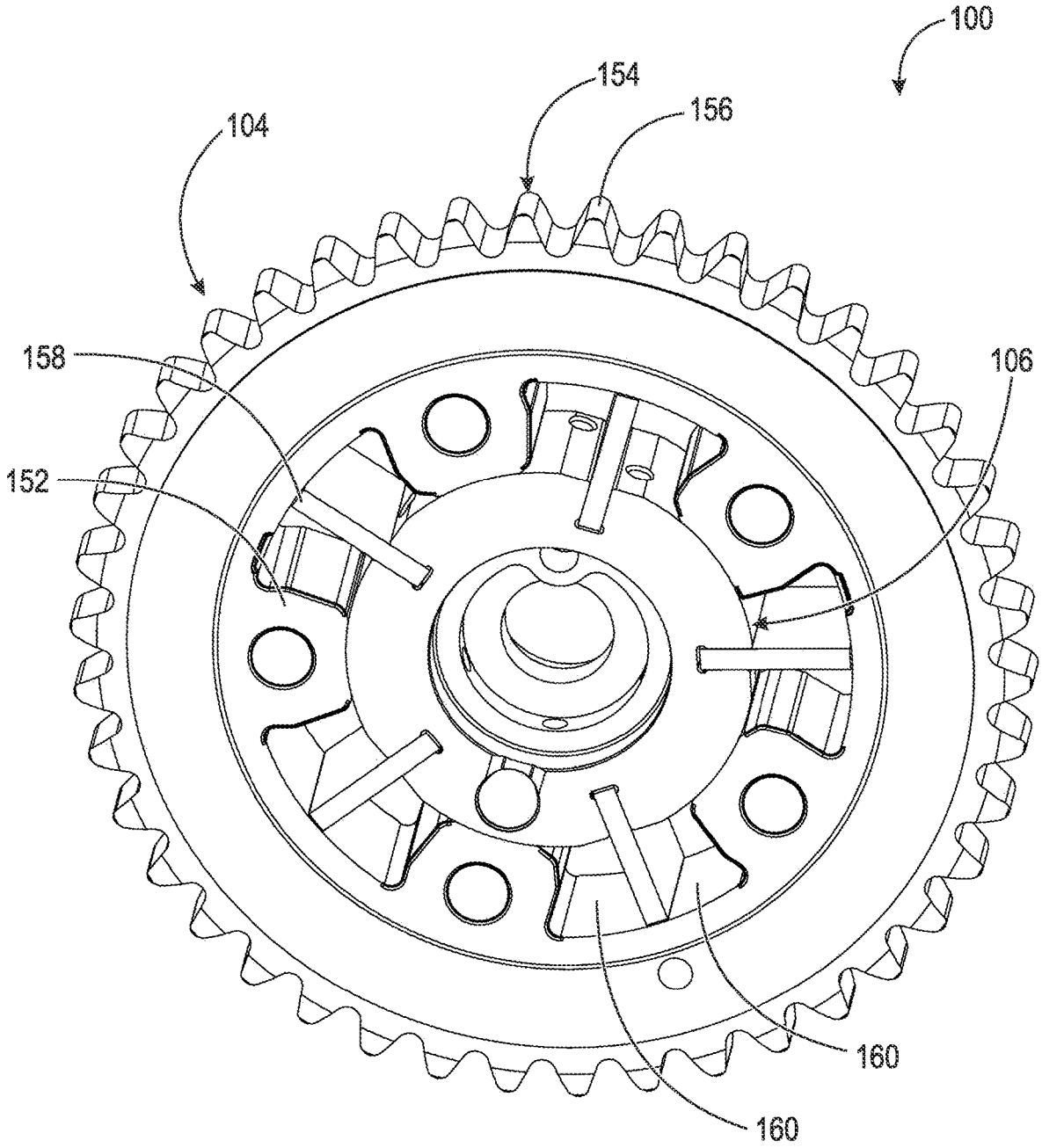
FIG. 3 is a rear isometric view of the camshaft phaser shown in FIG. 1 with a rear seal plate removed.

FIG. 3 is a rear isometric view of camshaft phaser 100 camshaft phaser shown in FIG. 1 with rear seal plate 112 removed. The following should be viewed in light of FIGS. 1 through 3. In the example of FIG. 1: camshaft phaser 100 is a hydraulic camshaft phaser; input element 104 includes a stator of the hydraulic camshaft phaser; and output element 106 includes a rotor of the hydraulic camshaft phaser.

In the example of FIG. 1, magnetic element 110 is a plastic material embedded with a magnetic material. Any plastic and magnetic materials known in the art can be used for magnetic element 110. In an example embodiment, the plastic material is polymer based and includes nylon, polyphenylene sulfide, polyamide, and combinations of nylon and polyamide. Examples of magnetic materials known in the art include but are not limited to: ferrite; neodymium; ferrite and neodymium hybrids; and samarium-cobalt. As is known in the art, the magnetic material of magnetic element 110 is magnetically activated to form one or more segments having a north magnetic charge and one or more segments having a south magnetic charge.

Figure 4:
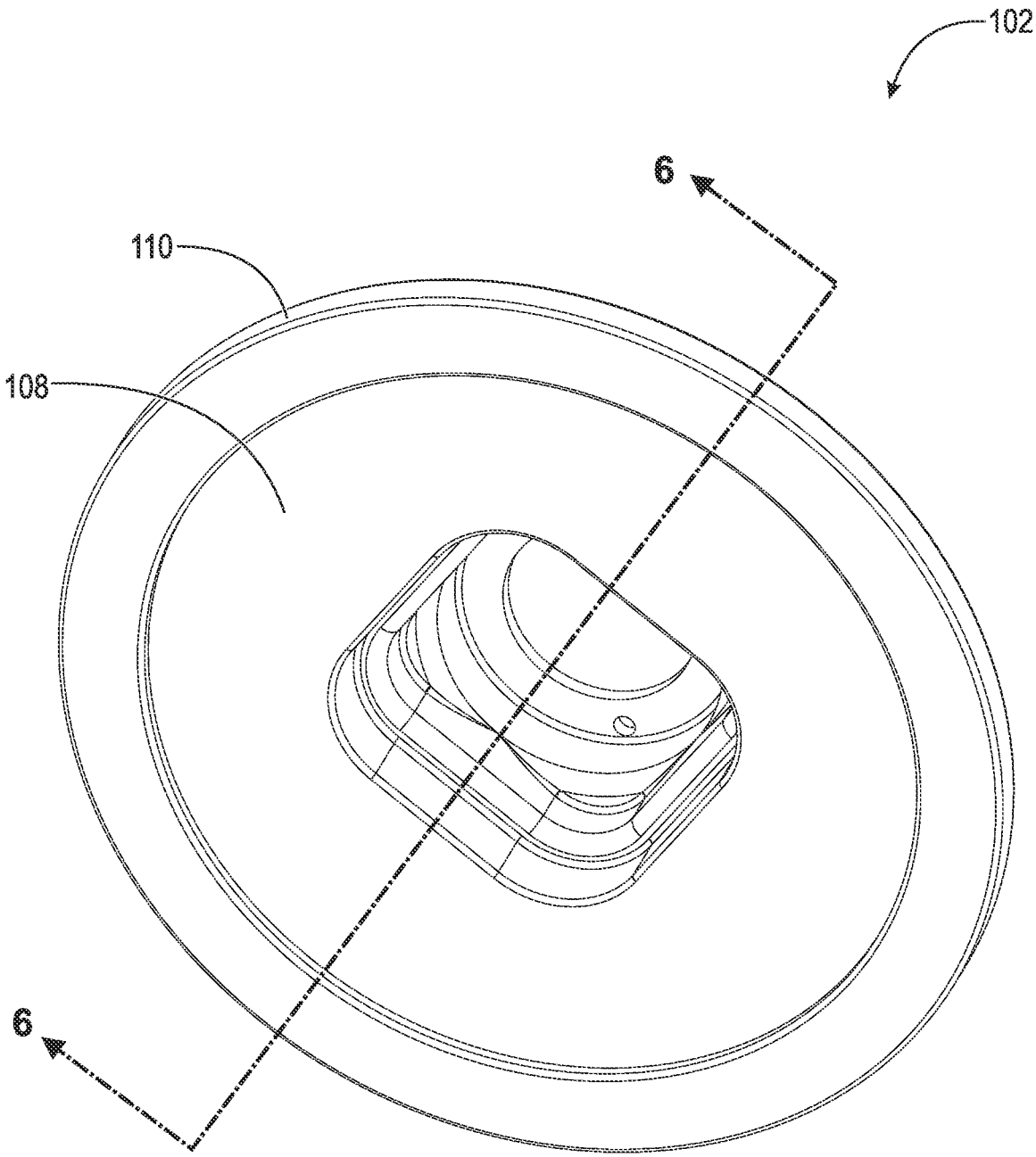
FIG. 4 is a front view of the trigger wheel shown in FIG. 1.

FIG. 4 is a front isometric view of trigger wheel 102 wheel shown in FIG. 1.

Figure 5:
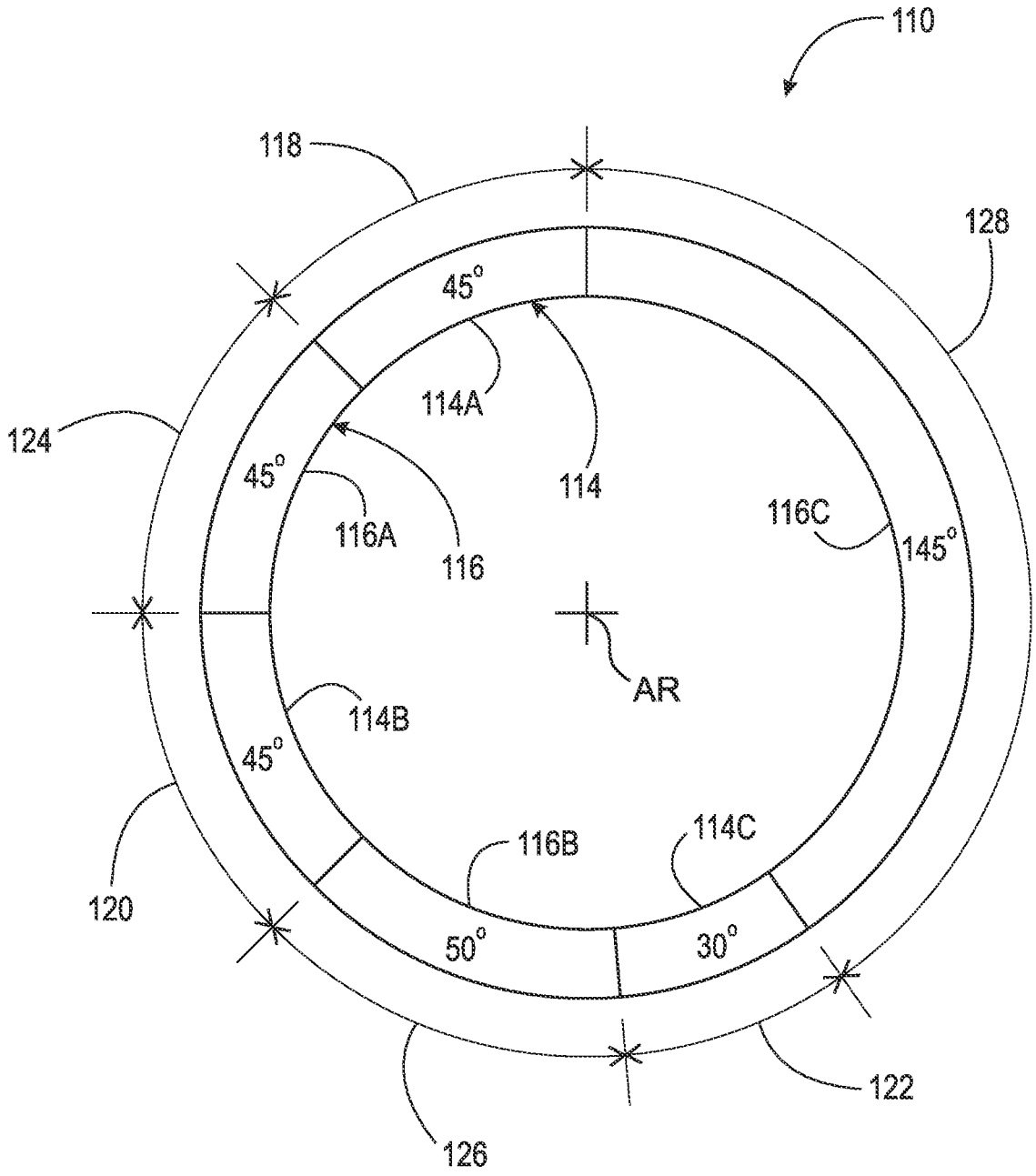
FIG. 5 is a front view of the magnetic material shown in FIG. 1.

FIG. 5 is a front view of magnetic material 110, shown in FIG. 1. The following should be viewed in light of FIGS. 1 through 5. In the example of FIG. 1, magnetic material 110: is circumferentially continuous; includes segments 114 with a first magnetic charge; and includes segments 116 with a second magnetic charge, opposite the first magnetic charge. In the example of FIG. 1, the first magnetic charge is a north magnetic charge, and the second magnetic charge is a south magnetic charge. It is understood the preceding charge configuration can be reversed. Segments 114 and 116 are circumferentially interleaved. By "circumferentially interleaved" we mean that segments 114 and 116 alternate in circumferential direction CD around axis of rotation AR.

The circumferential extents of segments 114 can be the same or can be different. The circumferential extents of segments 116 can be the same or can be different. The circumferential extents of segments 114 and 116 can be the same or can be different. In the example of FIG. 1: circumferential extent 118 of segment 114A is the same as circumferential extent 120 of segment 1148; circumferential extent 122 of segment 114C is different from extent 118; circumferential extent 124 of segment 116A is the same as circumferential extent 118; and circumferential extent 126 of segment 116B and circumferential extent 128 of segment 116C are different from circumferential extents 118, 120, 122, and 124. It is understood that: other numbers of segments 114 and 116 are possible; and other combinations of circumferential extents of segments 114 and 116 are possible.

In the discussion above and in the discussion that follows, capital letters are used to designate a specific component from a group of components otherwise designated by a three digit number, for example, in the discussion below, segments 114A is a specific examples from the plurality of segments 114.

Figure 6:
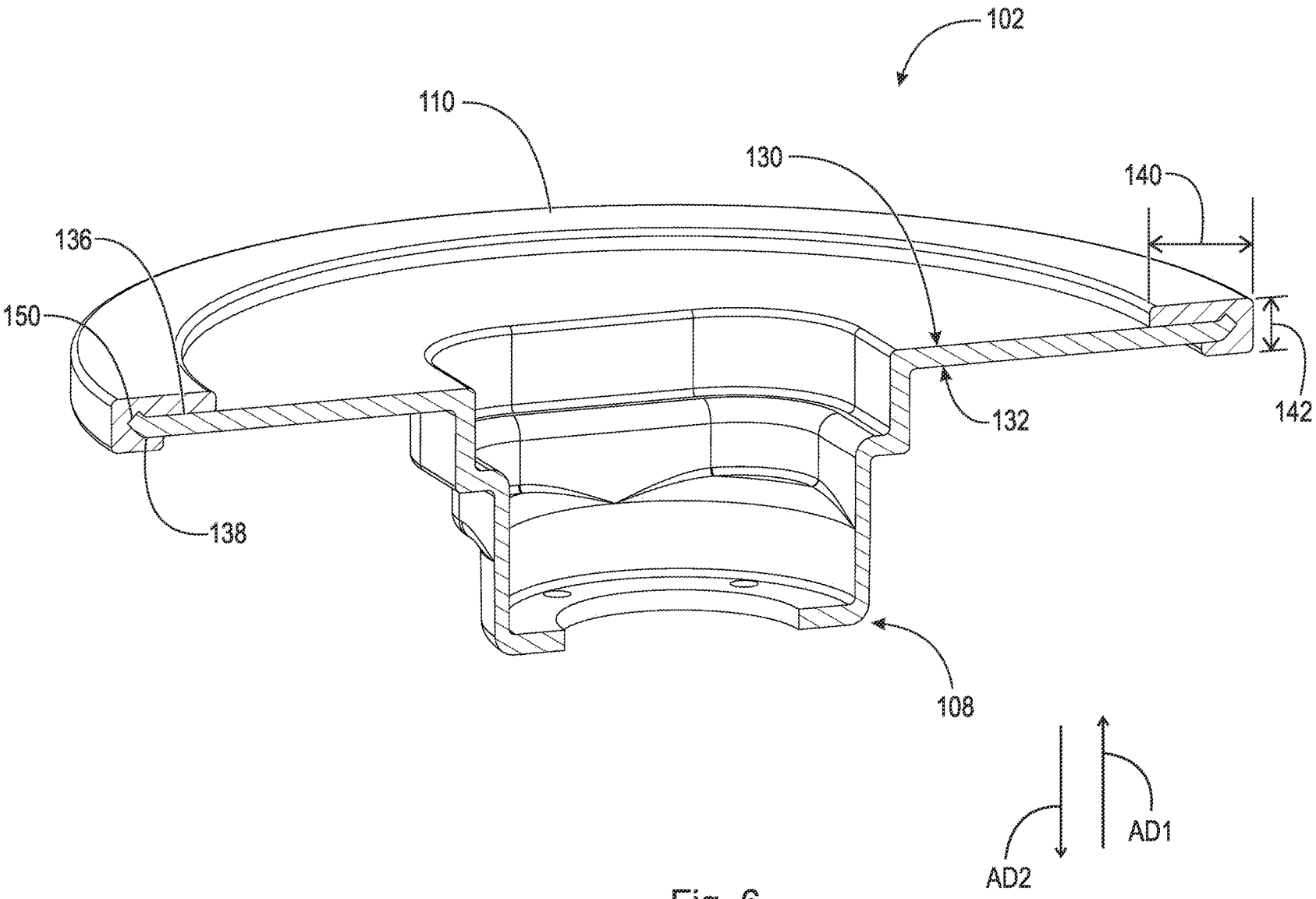
FIG. 6 is a cross-sectional view generally along line 6-6 in FIG. 4.

FIG. 6 is a cross-sectional view generally along line 6-6 in FIG. 4, The following should be viewed in light of FIGS. 1 through 6. Body portion 108 includes: side 130 facing at least partly in axial direction AD1, parallel to axis of rotation AR; side 132 facing at least partly in axial direction AD2, opposite direction AD1; and radially outer circumference 134 facing at least partly in radially outer direction RD, orthogonal to axis AR. In the example of FIG. 1, magnetic material 110 covers: portion 136 of side 130; portion 138 of side 132; and an entirety of radially outer circumference 134. In the example of FIG. 1, magnetic material 110 is: circumferentially continuous along portion 136; and circumferentially continuous along portion 138.

Figure 7:
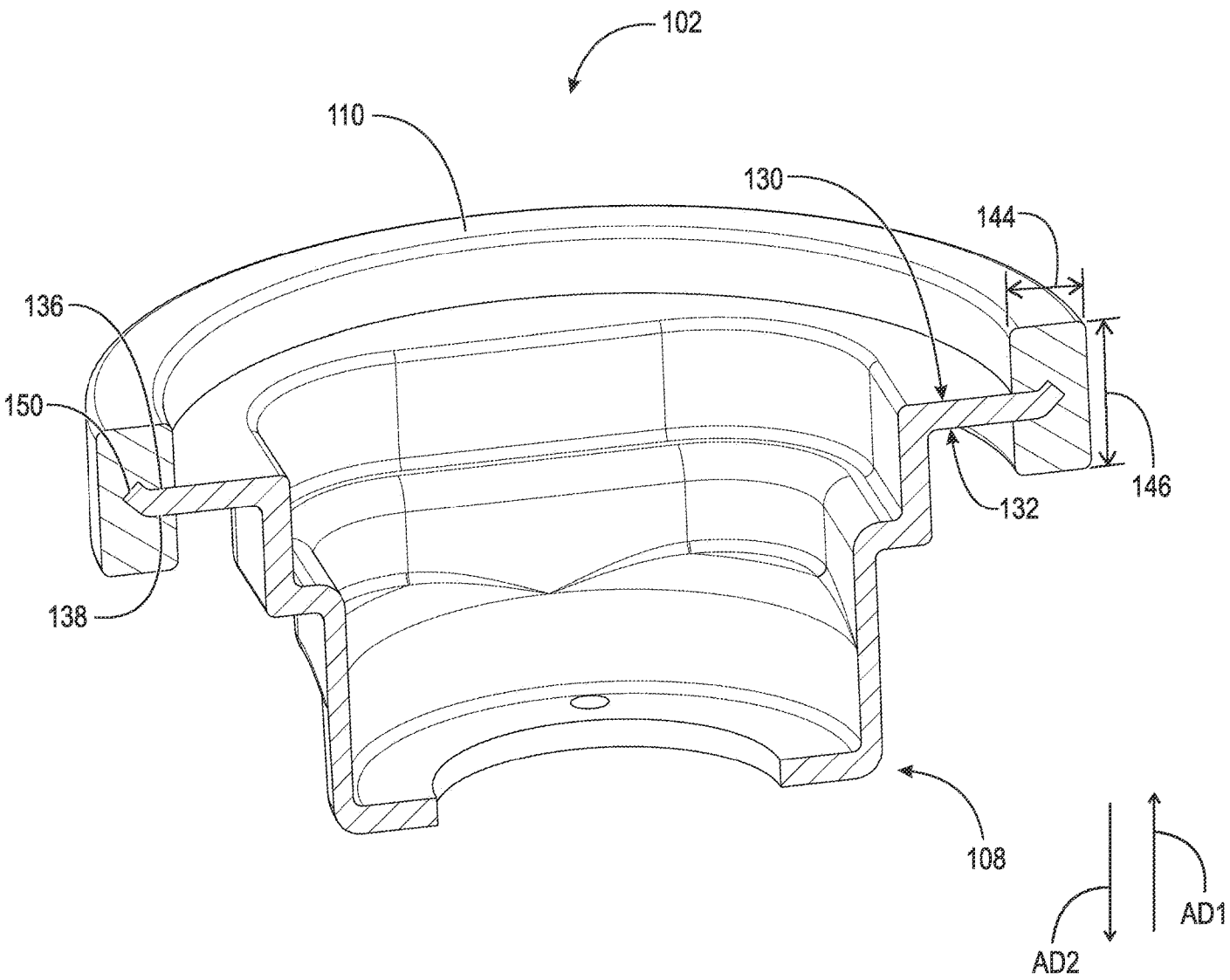
FIG. 7 is a cross-sectional view of an embodiment of the trigger wheel shown in FIG. 1.

FIG. 7 is a cross-sectional view of an embodiment of trigger wheel 102 shown in FIG. 1. The discussion for trigger wheel 102 shown in FIG. 6 is applicable to trigger wheel 102 shown in FIG. 7 except as noted. In FIG. 6, magnetic material 110 has maximum radial dimension 140 in direction RD and maximum axial dimension 142 in direction AD1. In FIG. 7, magnetic material 110 has maximum radial dimension 144 in direction RD and maximum axial direction 146 in direction AD1. Dimension 140 is greater than dimension 144, and dimension 146 is greater than dimension 142. In FIG. 6, magnetic material 110 has a larger area facing direction AD1; and in FIG. 7, magnetic material 110 has a larger area facing direction RD. Thus, the configuration of FIG. 6 is suited for an arrangement in which a sensor, detecting the magnetic charges of magnetic material 110, is axially aligned with magnetic material 110; and the configuration of FIG. 7 is suited for an arrangement in which a sensor, detecting the magnetic charges of magnetic material 110, is radially aligned with magnetic material 110. Magnetic material 110 is not limited to a particular combination of dimensions 140, 142, 144, and 146.

In the example of FIG. 1: body portion 108 includes radially outer surface segments 148 and tabs 150 extending radially outwardly from segments 148; and magnetic material 110 extends past tabs 150 in direction RD. Tabs 150 provide extra structure for securing magnetic material 110 to body portion 108. Trigger wheel 102 is not limited to a particular configuration or number of tabs 150.

Figure 8:
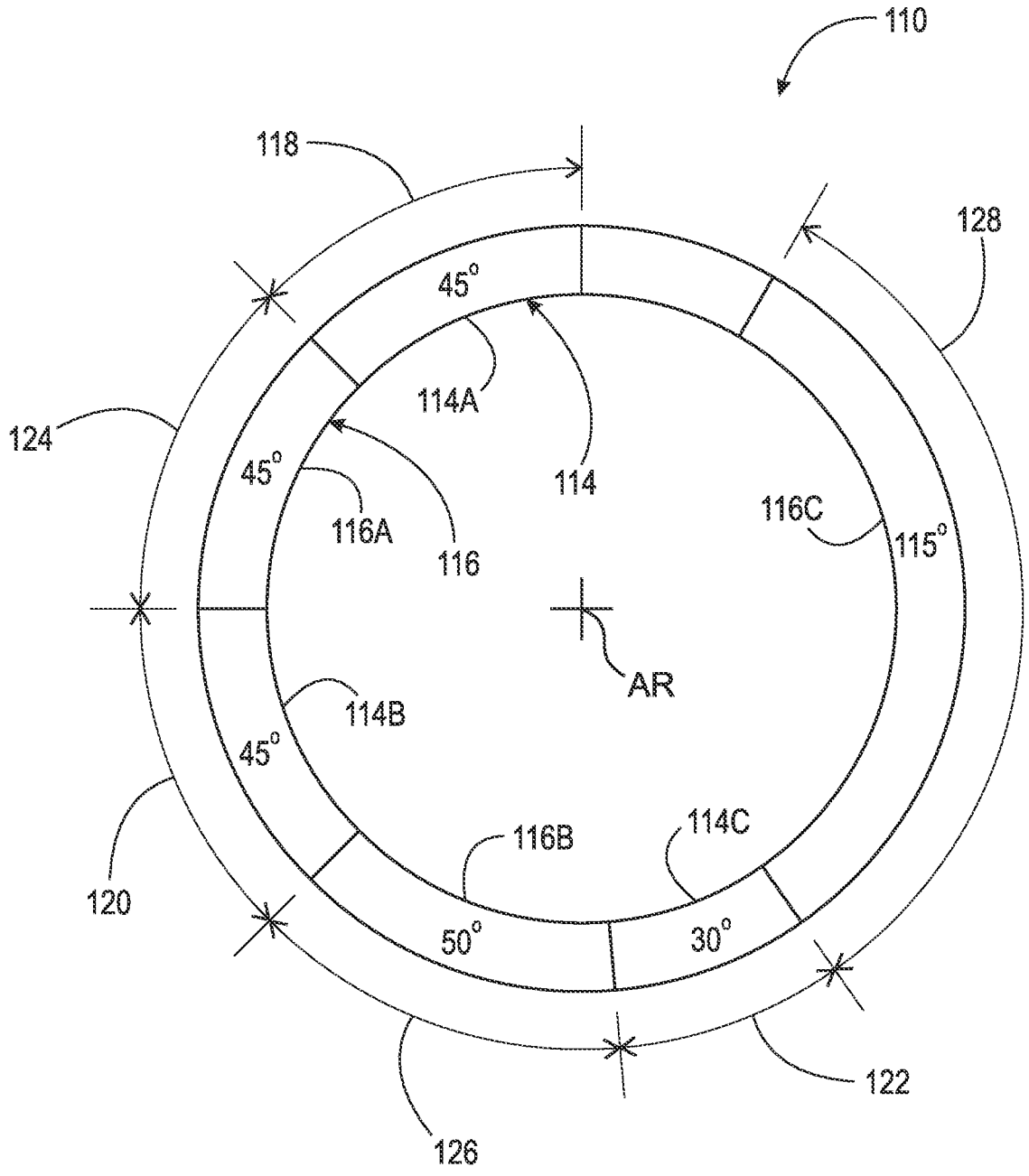
FIG. 8 is a front view of an embodiment of a magnetic material for the camshaft phaser shown in FIG. 1.

FIG. 8 is a front view of an embodiment of magnetic material 110 for camshaft phaser 100 shown in FIG. 1. Unless noted otherwise, the discussion of magnetic material 110 for FIGS. 1 through 6 is applicable to FIG. 8. In FIG. 8, extent 128 is less than extent 128 in FIG. 5 and magnetic material 110 is circumferentially discontinuous.

In the example of FIG. 1: input element 104 is a stator with radially inwardly extending protrusions 152 and input gear 154, with teeth 156, arranged to receive torque RT1; output element 106 is a rotor and includes radially outwardly extending protrusions 158 circumferentially interleaved with protrusions 152; and protrusions 152 and 158 circumferentially define chambers 160. In the example of FIG. 1, camshaft phaser 100 includes front seal plate 162 and bias spring 164.

Figure 9:
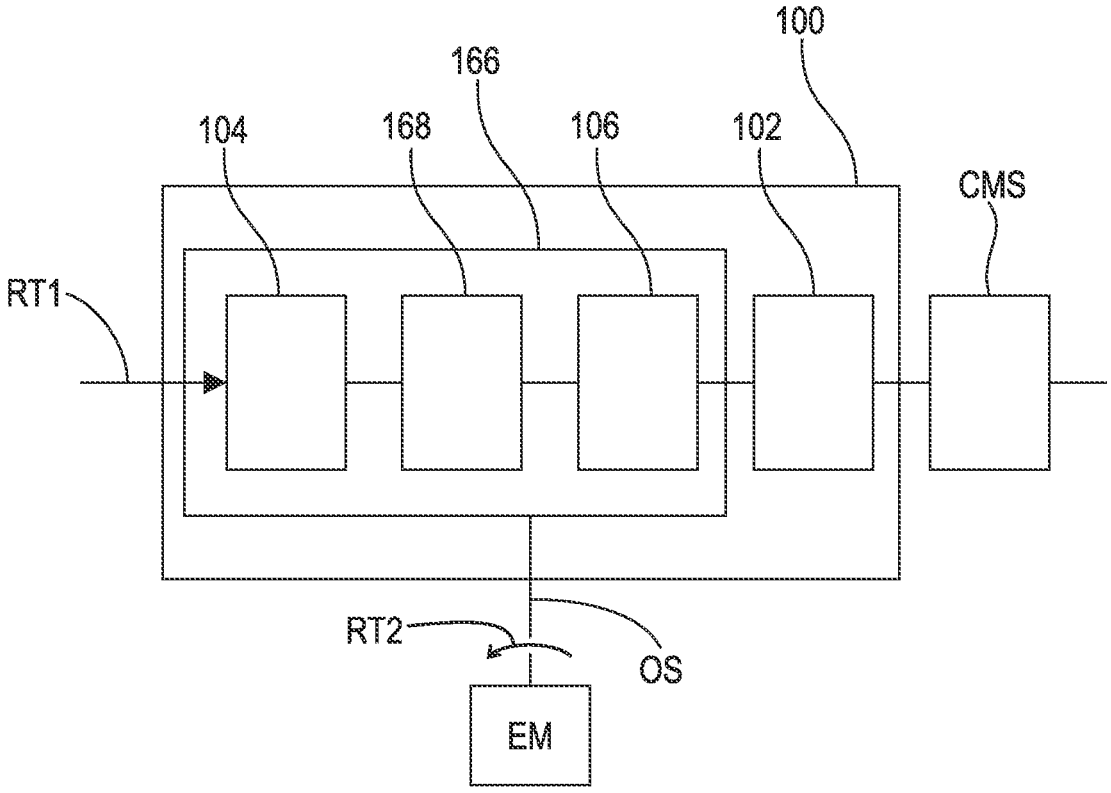
FIG. 9 is a schematic block diagram of a camshaft phaser with the trigger wheel including magnetic material.

FIG. 9 is a schematic block diagram of camshaft phaser 100 with trigger wheel 102 including magnetic material 110. Unless stated otherwise, the discussion for trigger wheel 102 and magnetic material 110 for FIGS. 1 through 8 is applicable to FIG. 9. In the example of FIG. 9, camshaft phaser 100 is an electric camshaft phaser including known gearbox 166. Gearbox 166 includes input element 104, control gear 168, and output element 106. Gearbox 166 is arranged to transmit torque RT1 to camshaft CMS. In the example of FIG. 9, control gear 168 is arranged to receive rotational torque RT2 via output shaft OS of electric motor EM. Control gear 168 uses torque RT2 to rotate output element 106 and camshaft CMS with respect to input element 104. Torque RT2 is not limited to a particular circumferential direction. In an example embodiment, not shown, motor EM is part of phaser 100.

The following should be viewed in light of FIGS. 1 through 9. The following describes a method of operating a camshaft phaser including an input element, an output element, a trigger wheel non-rotatably connected to the output element, and a magnetic material fixedly connected to the trigger wheel and including a segment with a first magnetic charge and a segment with a second magnetic charge, opposite the first magnetic charge. A first step receives, with the input element, a rotational torque. A second step rotates the input element around an axis of rotation. A third step transmits, with the input element, the rotational torque to the output element. A fourth step rotates the output element and the trigger wheel around the axis of rotation; A fifth step transmits, with the output element, the rotational torque to a camshaft non-rotatably connected to the output element. A sixth step detects, with a sensor, a circumferential position of the segment having the first magnetic charge. A seventh step transmits, with the sensor, a first sensor signal including the circumferential position, to a control unit. An eighth step creates, with the control unit and the first sensor signal, a first control signal. A ninth step transmits, using the control unit, the first control signal to a fluid control system or to an electric motor. For a tenth step: when the first control signal is transmitted to the fluid control system, rotating, using the fluid control system and according to the first control signal, the output element with respect to the input element; or when the first control signal is transmitted to the electric motor, rotating, using the electric motor, the output element with respect to the input element.

An eleventh step detects, with the sensor, a circumferential position of the segment with the second magnetic charge. A twelfth step transmits, with the sensor, a second sensor signal including the circumferential position of the segment with the second magnetic charge, to the control unit. A thirteenth step creates, with the control unit and the second sensor signal, a second control signal. For a fourteenth step: when the first control signal is transmitted to the fluid control system, transmitting, using the control unit, the second control signal to the fluid control system and rotating, using the fluid control system and according to the second control signal, the output element with respect to the input element; or when the first control signal is transmitted to the electric motor, transmitting, using the control unit, the second control signal to the electric motor and rotating, using the electric motor and according to the second control signal, the output element with respect to the input element.

Figure 10:
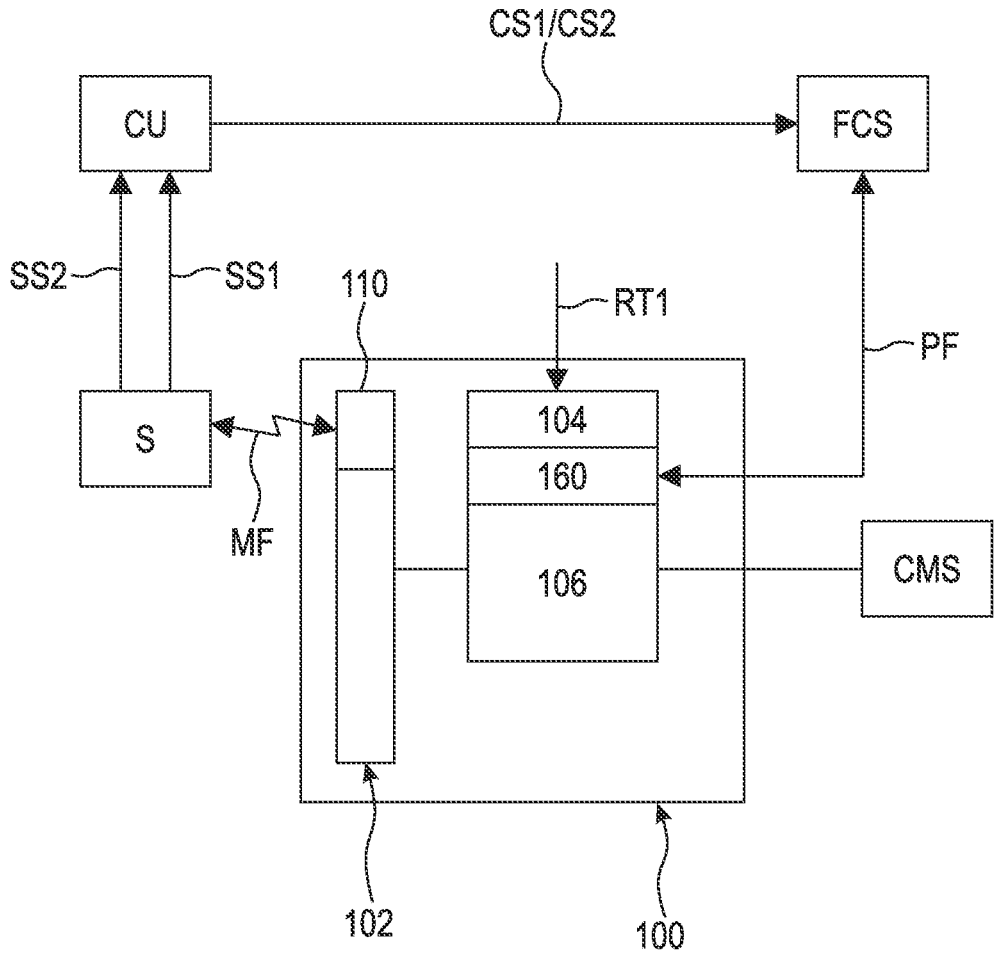
FIG. 10 is a schematic block diagram illustrating a method of operating the camshaft phaser shown in FIG. 1.

FIG. 10 is a schematic block diagram illustrating a method of operating camshaft phaser 100 shown in FIG. 1. A first step receives, with input element 104, rotational torque RT1. A second step rotates input element 104 around axis of rotation AR. A third step transmits, with input element 104, rotational torque RT1 to output element 106. A fourth step rotates output element 106 and trigger wheel 102 around axis of rotation AR. A fifth step transmits, with output element 106, rotational torque RT1 to camshaft CMS non-rotatably connected to output element 106. A sixth step detects, with sensor S and magnetic flux MF from material 110, a circumferential position of a segment 114. A seventh step transmits, with sensor 5, sensor signal SS1 including the circumferential position of the segment 114, to control unit CU, An eighth step creates, with control unit CU and sensor signal SS1, control signal CS1. A ninth step transmits, using control unit CU, control signal CS1 to fluid control system FCS. A tenth step rotates, according to control signal CS1, output element 106 with respect to input element 104 by controlling flow of pressurized fluid PF of fluid control system FCS into and out of chambers 160.

An eleventh step detects, with sensor S and magnetic flux MF from material 110, a circumferential position of a segment 116. A twelfth step transmits, with sensor S, sensor signal SS2, including the circumferential position of the segment 116, to control unit CU. A thirteenth step creates, with control unit CU and sensor signal SS2, control signal CS2. A fourteenth step transmits, using control unit CU, control signal CS2 to fluid control system FCS. A fifteenth step rotates, according to control signal CS2, output element 106 with respect to input element 104 by controlling flow of pressurized fluid PF from fluid control system FCS into and out of chambers 160.

Figure 11:
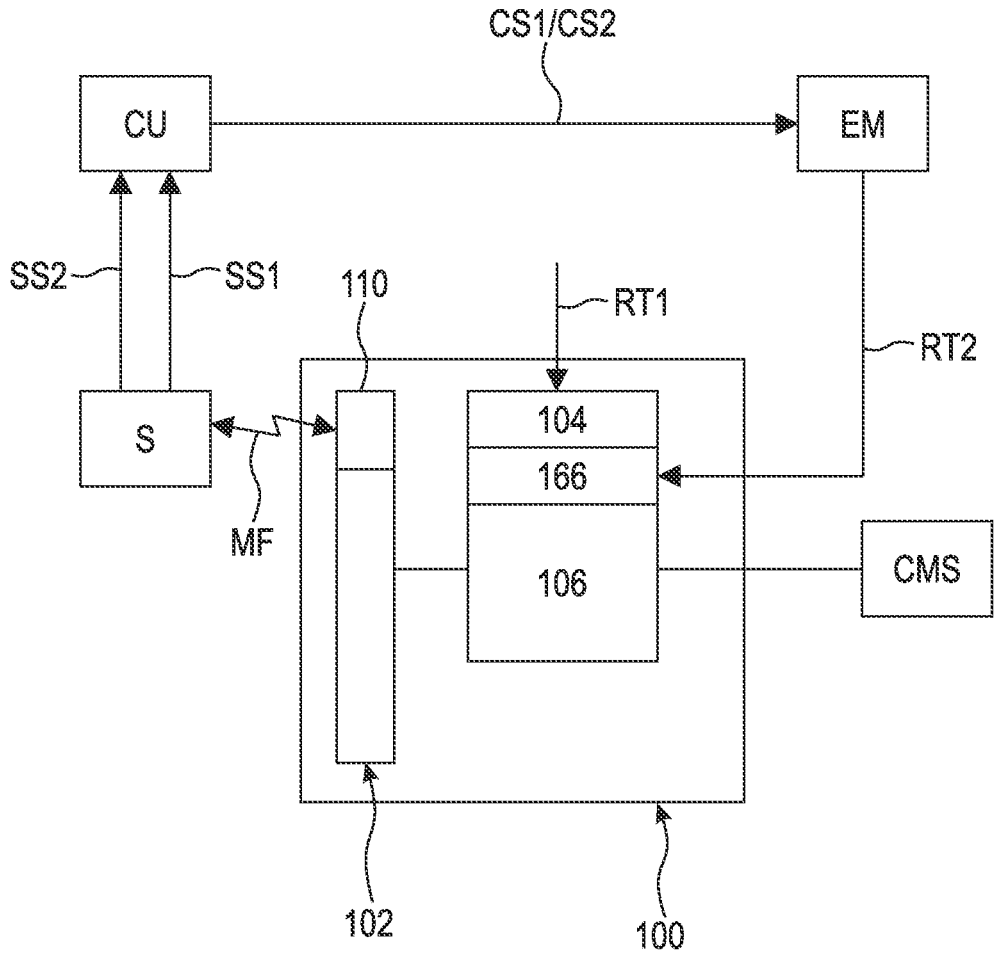
FIG. 11 is a schematic block diagram illustrating a method of operating the camshaft phaser shown in FIG. 9.

FIG. 11 is a schematic block diagram illustrating a method of operating camshaft phases 100 shown in FIG. 9. A first step receives, with input element 104, rotational torque RT1. A second step rotates input element 104 around axis of rotation AR. A third step transmits, with input element 104, rotational torque RT1 to output element 106. A fourth step rotates output element 106 and trigger wheel 102 around axis of rotation AR. A fifth step transmits, with output element 106, rotational torque RT1 to camshaft CMS non-rotatably connected to output element 106. A sixth step detects, with sensor S and magnetic flux MF from material 110, a circumferential position of a segment 114. A seventh step transmits, with sensor 5, sensor signal SS1 including the circumferential position of the segment 114, to control unit CU. An eighth step creates, with control unit CU and sensor signal SS1, control signal CS1. A ninth step transmits, using control unit CU, control signal CS1 to electric motor EM. A tenth step rotates, using motor EM and gearbox 166 and according to control signal CS1, output element 106 with respect to input element 104.

An eleventh step detects, with sensor S and magnetic flux MF from material 110, a circumferential position of a segment 116. A twelfth step transmits, with sensor S, sensor signal SS2, including the circumferential position of the segment 116, to control unit CU. A thirteenth step creates, with control unit CU and sensor signal SS2, control signal CS2. A fourteenth step transmits, using control unit CU, control signal CS2 to electric motor EM. A fifteenth step rotates, using motor EM and gearbox 166 and according to control signal CS2, output element 106 with respect to input element 104.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

AD1 axial direction
AD2 axial direction
AR axis of rotation
CS1 control signal
CS2 control signal
CD circumferential direction
CMS camshaft
CU control unit
EM electric motor
FCS fluid control system
MF magnetic flux
OS output shaft
PF pressurized fluid
RD radially outer direction
RT1 rotational torque
RT2 rotational torque
S sensor
SS1 sensor signal
SS2 sensor signal
100 camshaft phaser
102 trigger wheel
104 input element
106 output element
108 body portion, trigger wheel
110 magnetic material
111 camshaft bolt
112 rear seal plate
114A segment, magnetic material
114B segment, magnetic material
114C segment, magnetic material
116A segment, magnetic material
116B segment, magnetic material
116C segment, magnetic material
118 circumferential extent
120 circumferential extent
122 circumferential extent
124 circumferential extent
126 circumferential extent
128 circumferential extent
130 side, body portion
132 side, body portion
134 radially outer circumference
136 portion, side
138 portion, side
140 dimension, magnetic material
142 dimension, magnetic material
144 dimension, magnetic material
146 dimension, magnetic material
148 radially outer surface, body portion
150 tab, body portion
152 protrusion, stator
154 input gear
156 tooth, input gear
158 protrusion, rotor
160 chamber
162 front seal plate
164 bias spring
166 gearbox
168 control gear

The invention claimed is:

1. A camshaft phaser, comprising:
an input element:
arranged to receive a first rotational torque; and,
rotatable about an axis of rotation;
an output element:
rotatable about the axis of rotation;
rotatable with respect to the input element;
arranged to non-rotatably connect to a camshaft; and
arranged to transmit the first rotational torque to the camshaft; and,
a trigger wheel:
non-rotatably connected to the output element;
arranged to identify a rotational position of the output element around the axis of rotation;
including a circumferentially continuous magnetic material with at least one segment having a first magnetic charge, and with at least one segment having a second magnetic charge, opposite the first magnetic charge; and
including a radially outer circumferential surface facing in a radially outer direction, orthogonal to the axis of rotation, and the circumferentially continuous magnetic material fully covers the radially outer circumferential surface;
wherein the trigger wheel includes a first surface facing in a first axial direction, the first axial direction being parallel to the axis of rotation;
wherein the magnetic material includes a first portion covering a segment of the first surface; and,
wherein the first portion is circumferentially discontinuous on the segment of the first surface.

2. The camshaft phaser of claim 1, wherein:
the trigger wheel includes a second surface facing in a second axial direction, opposite the first axial direction;
the magnetic material includes a second portion covering a segment of the second surface; and,
the second portion is circumferentially continuous on the segment of the second surface.

3. The camshaft phaser of claim 1, wherein:
the trigger wheel includes a second surface facing in a second axial direction, opposite the first axial direction;
the magnetic material includes a second portion covering a segment of the second surface; and,
the second portion is circumferentially discontinuous on the segment of the second surface.

4. The camshaft phaser of claim 1, wherein:
the at least one segment having the first magnetic charge includes:
a first segment with a first circumferential extent; and,
a second segment with the first circumferential extent; and, the at least one segment having the second magnetic charge includes a segment having the second magnetic charge located between the first segment of the at least one segment and the second segment of the at least one segment.

5. The camshaft phaser of claim 1, wherein:

the at least one segment having the second magnetic charge includes:

a first segment with a first circumferential extent; and, a second segment with a second circumferential extent different from the first circumferential extent; and, the at least one segment having the first magnetic charge includes a segment having the first magnetic charge located between the first segment of the at least one segment and the second segment of the at least one segment.

6. The camshaft phaser of claim 1, wherein:

the at least one segment having the second magnetic charge includes:

a first segment with a circumferential extent; and, a second segment with the circumferential extent; and, the at least one segment having the first magnetic charge includes a segment having the second magnetic charge located between the first segment of the at least one segment and the second segment of the at least one segment.

7. The camshaft phaser of claim 1, wherein:

the trigger wheel includes a radially outer circumference furthest from the axis of rotation; and, at least a portion of the magnetic material is further from the axis of rotation than the radially outer circumference of the trigger wheel.

8. The camshaft phaser of claim 1, wherein:

the camshaft phaser is a hydraulic camshaft phaser;

the input element includes a stator of the hydraulic camshaft phaser;

the output element includes a rotor of the hydraulic camshaft phaser;

the stator includes a plurality of radially inwardly extending protrusions; and, the rotor includes a plurality of radially inwardly extending protrusions:

circumferentially interleaved with the plurality of radially inwardly extending protrusions; and, circumferentially defining, with the plurality of radially inwardly extending protrusions, a plurality of chambers, the plurality of chambers arranged to receive and discharge a pressurize fluid to change a circumferential position of the rotor with respect to the stator.

9. The camshaft phaser of claim 1, wherein:

the camshaft phaser is an electric camshaft phaser including a gearbox;

the gearbox includes the input element and the output element; and the gearbox is arranged to:

receive a second rotational torque; and, control a circumferential position of the output element, with respect to the input element, around the axis of rotation.

10. A camshaft phaser, comprising:

an input element:

arranged to receive a first rotational torque; and, rotatable about an axis of rotation;

an output element:

rotatable about the axis of rotation;

rotatable with respect to the input element;

arranged to non-rotatably connect to a camshaft; and arranged to transmit the first rotational torque to the camshaft; and, a trigger wheel:

non-rotatably connected to the output element;

arranged to identify a rotational position of the output element around the axis of rotation;

including a body portion including a first surface facing in a first axial direction, parallel to the axis of rotation, a second surface facing in a second axial direction, opposite the first axial direction, and a radial surface facing in a radially outer direction, orthogonal to the axis of rotation; and including a magnetic material with at least one segment having a first magnetic charge, and with at least one segment having a second magnetic charge, opposite the first magnetic charge, the magnetic material including a first portion covering a segment of the first surface, a second portion covering a segment of the second surface, and a radial portion overlapping the radial surface of the body portion and connecting the first portion to the second portion.

* * * * *